US005396249A

United States Patent [19]

Yamada et al.

[11] Patent Number: 5,396,249

[45] Date of Patent: Mar. 7, 1995

[54] MICROWAVE ABSORBER AND PROCESS FOR MANUFACTURING SAME

[75] Inventors: Shinichi Yamada, Nagoya; Kyoji Miyata, Yokohama; Kazuhiko Mori, Higashikurume; Osamu Yamamoto, Tokyo; Yukitoshi Sato, Yachiyo, all of Japan

[73] Assignees: Otsuka Science Co., Ltd.; Nitto Boseki Co., Ltd., both of Japan

[21] Appl. No.: 115,739

[22] Filed: Sep. 3, 1993

[30] Foreign Application Priority Data

Apr. 28, 1993 [JP] Japan ..... 5-103158

[51] Int. Cl.[6] ..... H01Q 17/00

[52] U.S. Cl. ..... 342/1; 342/4

[58] Field of Search ..... 342/1, 4

[56] References Cited

U.S. PATENT DOCUMENTS

| | | | |
|---|---|---|---|
| 2,464,006 | 3/1949 | Tiley | 342/4 |
| 2,977,591 | 3/1961 | Tanner | 342/1 |
| 3,721,982 | 3/1973 | Wesch | 342/1 |
| 3,836,967 | 9/1974 | Wright | 342/4 |
| 4,003,840 | 1/1977 | Ishino et al. | 342/1 X |
| 4,538,151 | 8/1985 | Hatakeyama et al. | 342/1 |

OTHER PUBLICATIONS

"Foam Plastics handle a wide range of jobs" Electronics, Oct. 56 pp. 196–199.

Japanese Patent Appln. No. JP-A-59-169199, published Sep. 25, 1984.

Japanese Patent Appln. No. JP-B-4-79369, published Dec. 15, 1992.

Japanese Patent Appln. No. JP-A-2-174295, published Jul. 5, 1990.

Japanese Patent Appln. No. JP-A-4-36664, published Feb. 6, 1992.

Japanese Patent Appln. No. JP-A-4-38900, published Feb. 10, 1992.

Japanese Patent Appln. No. JP-A-2-189999, published Jul. 25, 1990.

*Primary Examiner*—Gilberto Barrón, Jr.

*Attorney, Agent, or Firm*—Beveridge, DeGrandi, Weilacher & Young

[57] ABSTRACT

A microwave absorber in a pointed shape, including a phenol resin foam containing a dielectric loss material, is prepared by setting an incombustible sheet container of a same shape in a mold in a pointed shape, pouring the phenol resin to which the dielectric loss material is blended, and foaming and curing. As a result, a semi-incombustible or incombustible microwave absorber of high strength possessing a high microwave absorption capacity in a wideband is obtained.

13 Claims, 11 Drawing Sheets

MICROWAVE ABSORBER AND PROCESS FOR MANUFACTURING SAME

BACKGROUND OF THE INVENTION

The present invention relates to microwave absorbers used in RF anechoic chambers or the like, and a method of manufacturing the same, and more particularly, to a semi-incombustible or incombustible microwave absorber excellent in its microwave absorbing capacity, and a process for manufacturing the same.

Hitherto, the RF anechoic chamber has been widely employed for uses of measurement of antenna characteristic, and measurement of radio noise emission. In such RF anechoic chambers, to eliminate reflection of microwaves in the chamber, as shown in FIG. 10, the walls of an electromagnetic shielding enclosure 3 are lined with microwave absorbers 4.

The microwave absorber 4 is to absorb incoming microwave without reflection and convert into heat. In an ordinary microwave absorber 4, a resin foam impregnated with carbon black or the like is used. It is often formed in a pyramid-shape as shown in FIGS. 11(*a*) and 11(*b*). Although the microwave absorption characteristic in high frequency region is inferior to that of pyramid form, as shown in FIGS. 12(*a*) and 12(*b*), a wedge-shaped microwave absorber 4' is also known. FIGS. 11(*a*) and 11(*b*) show side view and plan view of the pyramid-shape microwave absorber 4, and FIGS. 12(*a*) and 12(*b*) show similarly side view and plan view of the wedge-shape microwave absorber 4'.

As the resin foam, usually, foamed polystyrene, foamed polyurethane, or foamed crosslinked polyethylene is used.

In forming foamed polystyrene, beads of foamable polystyrene are used. These beads are, however, relatively large particles of about 0.1 to 1 mm. Therefore the cell diameter of the foam becomes large, and a sufficient microwave absorption is not achieved unless much carbon black is mixed in. Moreover, the foamed polystyrene is limited to the use of relatively low frequency band, and cannot be used for high frequency bands of, for example, 10 GHz or more. Furthermore, since the cut foamed polystyrene is fragile, the tip of the pyramid-shape microwave absorber is likely to be broken, and hence a particular caution is needed.

On the other hand, foamed polyurethane is soft, so that the tip is hardly broken if formed in a pyramid-shape, and the cell diameter is small, so that it can be used in high frequency band of 10 to 100 GHz. However, to manufacture a microwave absorber of polyurethane foam requires the steps of jigging the foam, immersing the foam in a latex liquid containing carbon black in a compressed state, releasing the compression to impregnate the latex, and drying. Therefore, the impregnated latex is moved to the lower part when drying, so that the carbon black cannot be contained uniformly, and unevenness is likely to occur.

Because of use of foamed polyurethane, moreover, only a flame retardant microwave absorber can be obtained. However, when a strong microwave is continuously radiated to a same position of the microwave absorber, heat is generated inside due to dielectric loss, which may lead to risk of ignition or combustion. Accordingly, the flame retardant material is insufficient, and semi-incombustible or incombustible material is required.

On the other hand, as for crosslinked polyethylene foam, only a flame retardant material can be manufactured, the same as in the case of foamed polyurethane, and semi-incombustible or incombustible material can not be obtained. In particular, the crosslinked polyethylene foam is easily melted by heat, and hot molten lumps may drop to burn the people standing beneath the absorber.

Besides, since the microwave absorbers using such foams contain black conductive powder (dielectric loss material) such as carbon black, and the surface has a dark gray or black color, therefore when installed in RF anechoic chambers or the like, the lighting effect is low, and it may not only look dark, but also give a threatening feel to the user because of the color and pointed shape of pyramid or the like. Conventionally, therefore, the surface of the microwave absorber was painted in blue or the like after forming, which took labor, and uniform painting was difficult because of the pointed shape, and it was hence costly.

SUMMARY OF THE INVENTION

It is hence a primary object of the invention to provide a microwave absorber which possesses a high microwave absorbing capacity in a wideband, and is semi-incombustible or incombustible.

It is other object of the invention to provide a microwave absorber possessing a high strength even at low density, and a method of manufacturing the same.

It is a further object of the invention to provide a microwave absorber capable of obtaining a colored microwave absorber easily and at low cost by saving the labor of painting in the later process, and a method of manufacturing the same.

To achieve these objects, the invention presents a microwave absorber comprising a phenol resin foam containing a dielectric loss material.

More specifically, the microwave absorber of the invention is made of a thermosetting phenol resin foam, and is hence semi-incombustible or incombustible, and does not ignite, burn, or melt due to internal heat generation by continuous radiation of strong microwave to a same position. Still more, since the phenol resin foam has a small cell diameter, by addition of a relatively small amount of dielectric loss material, a uniform and wideband microwave absorber with a high microwave absorption capacity is obtained.

In particular, when the microwave absorber of the invention is formed in a pyramid-shape, it excels in the microwave absorption characteristic in the high frequency band.

Furthermore, when the phenol resin foam is covered with a colored incombustible sheet, a colored microwave absorber may be obtained easily.

The microwave absorber of the invention with the surface covered with an incombustible sheet may be manufactured by setting, into a mold of a tapered shape, a container of incombustible sheet of the same shape, then, pouring a phenol resin blending a dielectric loss material, and foaming and curing.

As a result, the molded foam can be parted easily, and productivity is enhanced. By using a form retaining container, the molded foam is protected, and the strength is enhanced. Therefore, it is possible to use foam of low density, so that a lightweight microwave absorber can be manufactured at a low cost. Weight reduction of the foamed absorber particularly contributes to the working efficiency.

The shape of the microwave absorber of the invention is not limited to a pyramid-shape alone, and other arbitrary shapes including the wedge shape mentioned above may be employed.

DETAILED DESCRIPTION OF THE INVENTION

Figure 1:
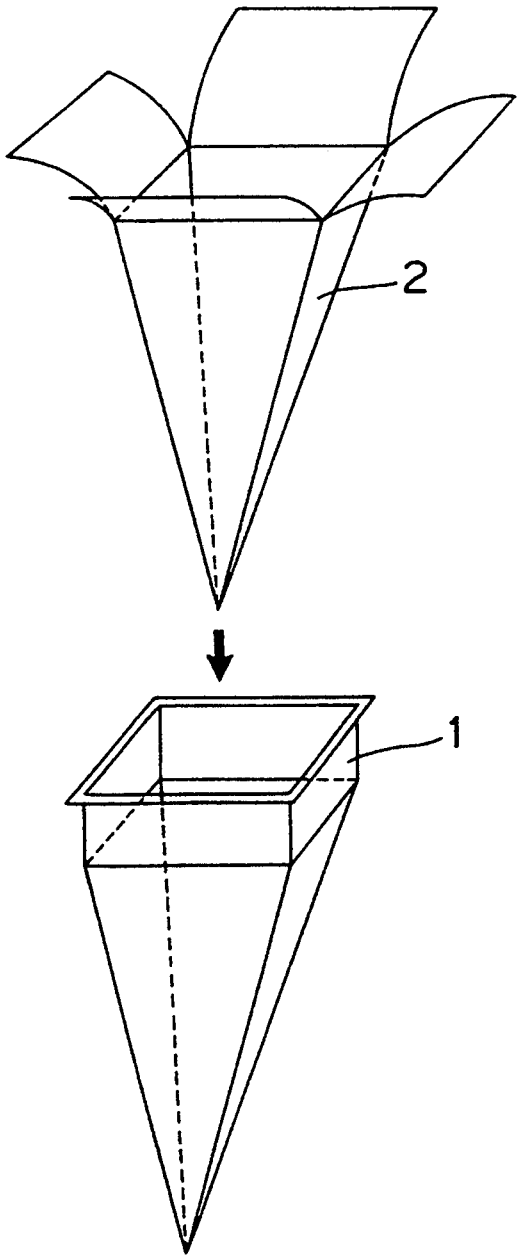
FIG. 1 is an explanatory diagram showing an example of a mold for use in manufacture of a microwave absorber of the invention, and a container of incombustible sheet to be set therein.
Figure 2:
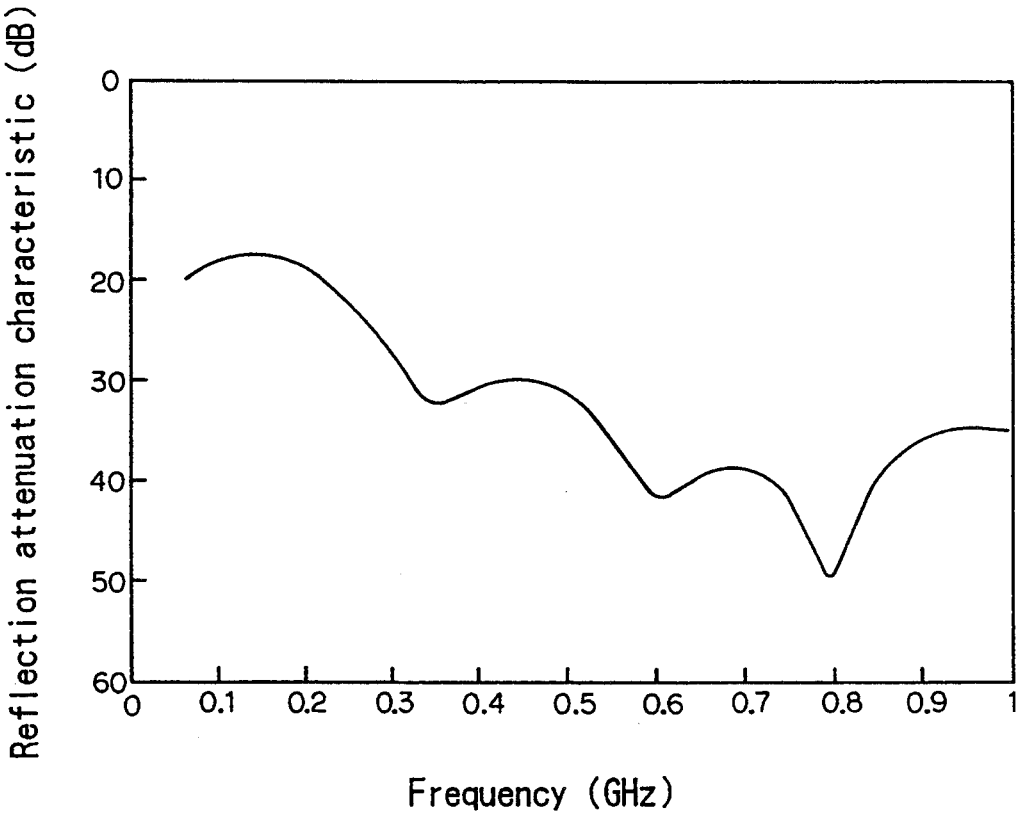
FIG. 2 is a graph showing a microwave absorption characteristic of a microwave absorber obtained in Example 1 (height: 600 mm, setting of 3.5 mm thick ferrite tile, dielectric loss material content: 3.5 g/liter, molding density: 102 kg/m$^3$).
Figure 3:
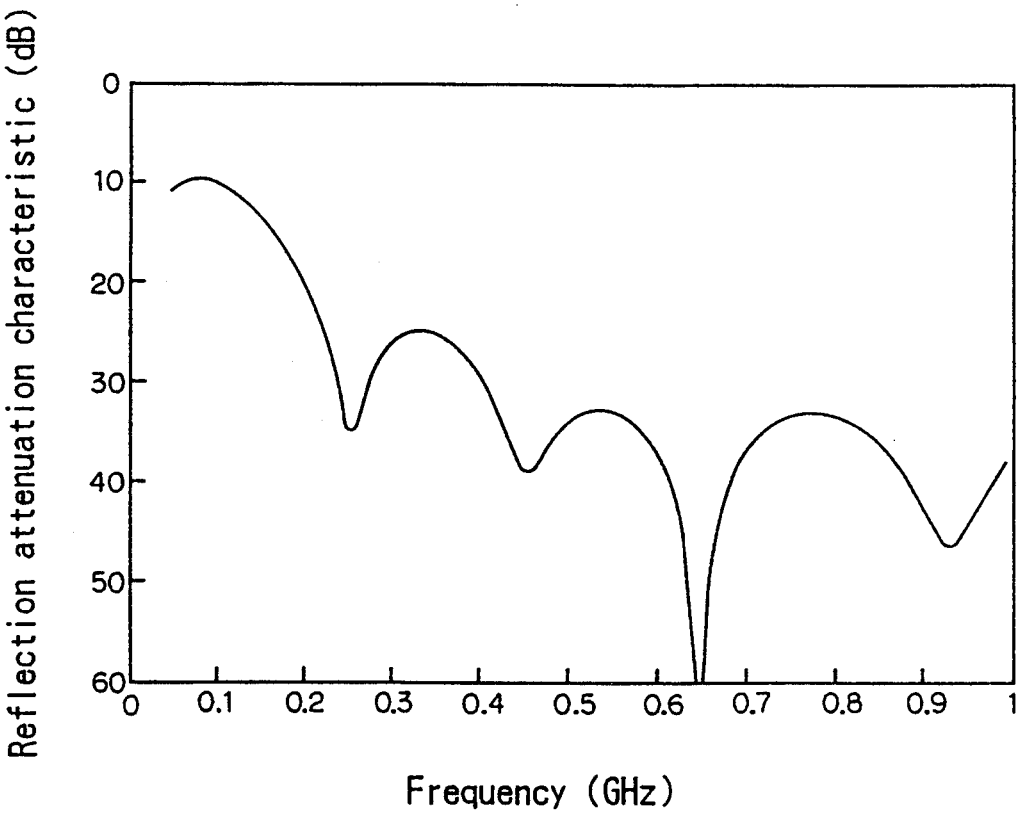
FIG. 3 is a graph showing a microwave absorption characteristic of a microwave absorber obtained in Example 2 (height: 600 mm, setting of 3.5 mm thick ferrite tile, dielectric loss material content: 6.5 g/liter, molding density: 147 kg/m$^3$).
Figure 4:
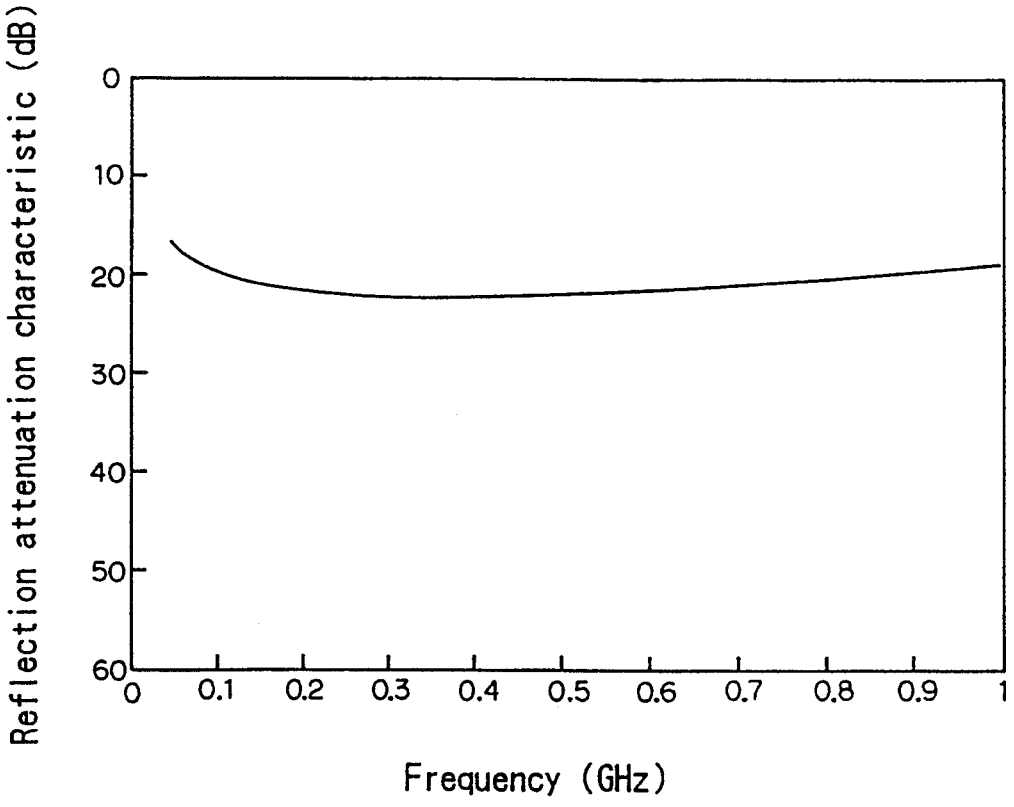
FIG. 4 is a graph showing a microwave absorption characteristic of a microwave absorber obtained in Example 3 (height: 600 mm, setting of 4.5 mm thick ferrite tile, dielectric loss material content: 0.3 g/liter, molding density: 53 kg/m$^3$).
Figure 5:
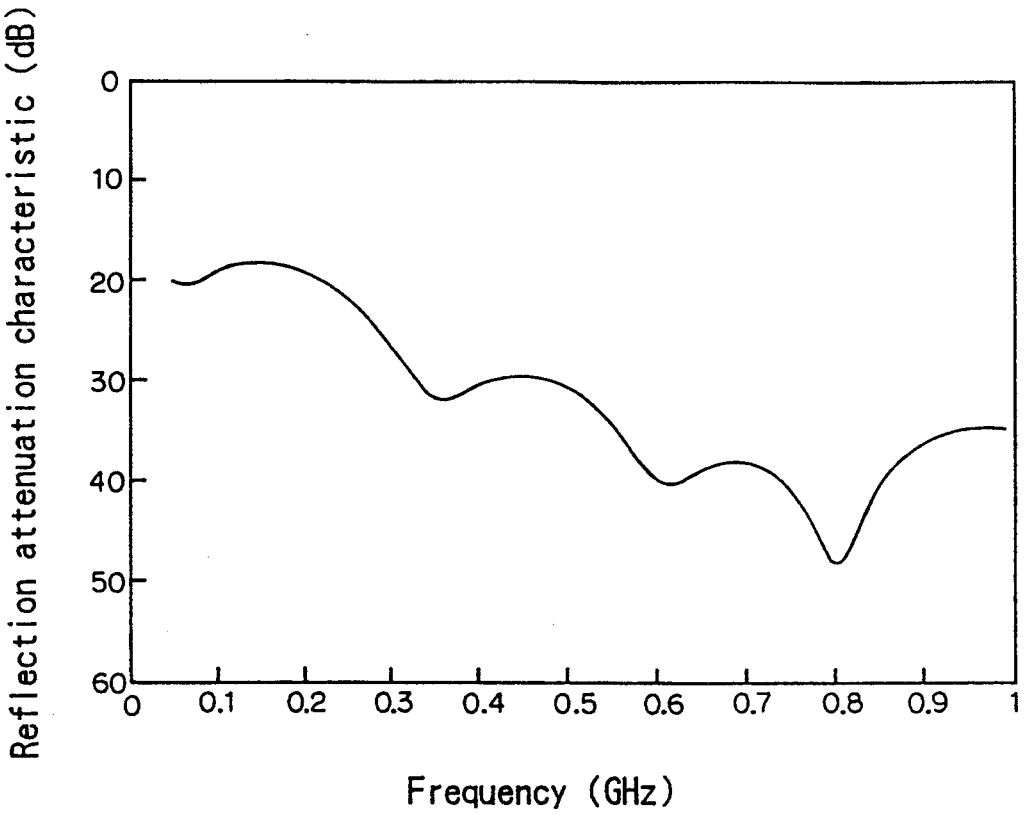
FIG. 5 is a graph showing a microwave absorption characteristic of a microwave absorber obtained in Example 4 (height: 600 mm, setting of 3.5 mm thick ferrite tile, dielectric loss material content: 3.5 g/liter, molding density: 90 kg/m$^3$).
Figure 6:
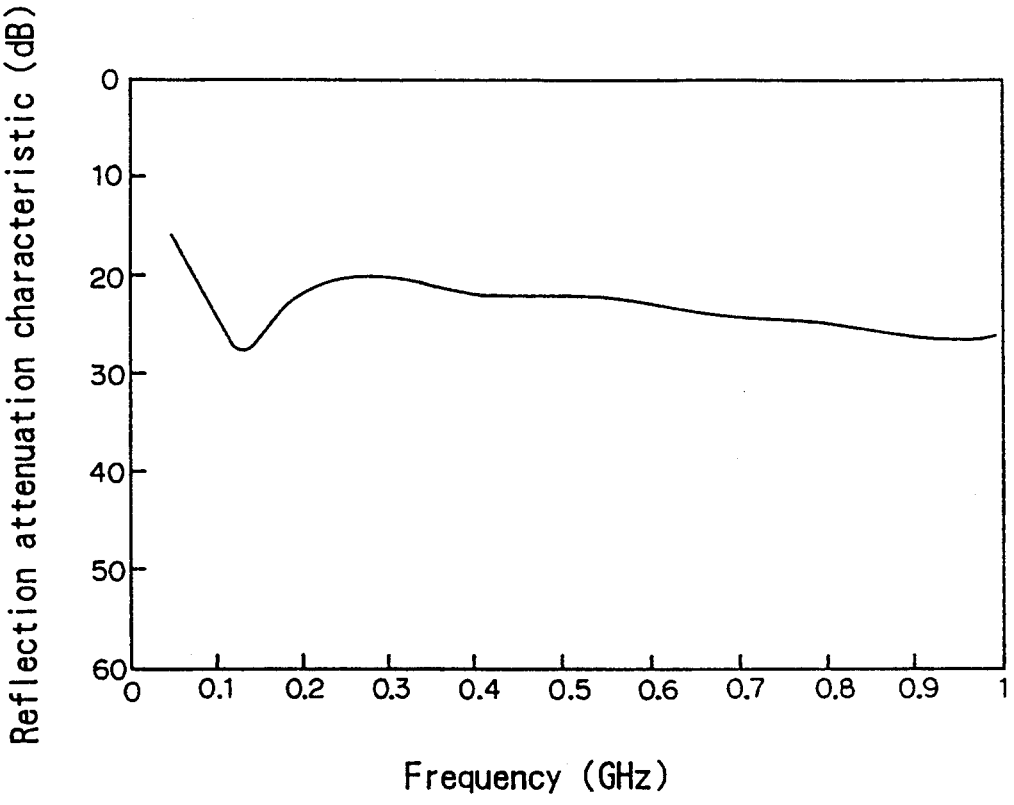
FIG. 6 is a graph showing a microwave absorption characteristic of a microwave absorber obtained in Example 5 (height: 600 mm, setting of 3.5 mm thick ferrite tile, dielectric loss material content: 1.8 g/liter, molding density: 98 kg/m$^3$).
Figure 7:
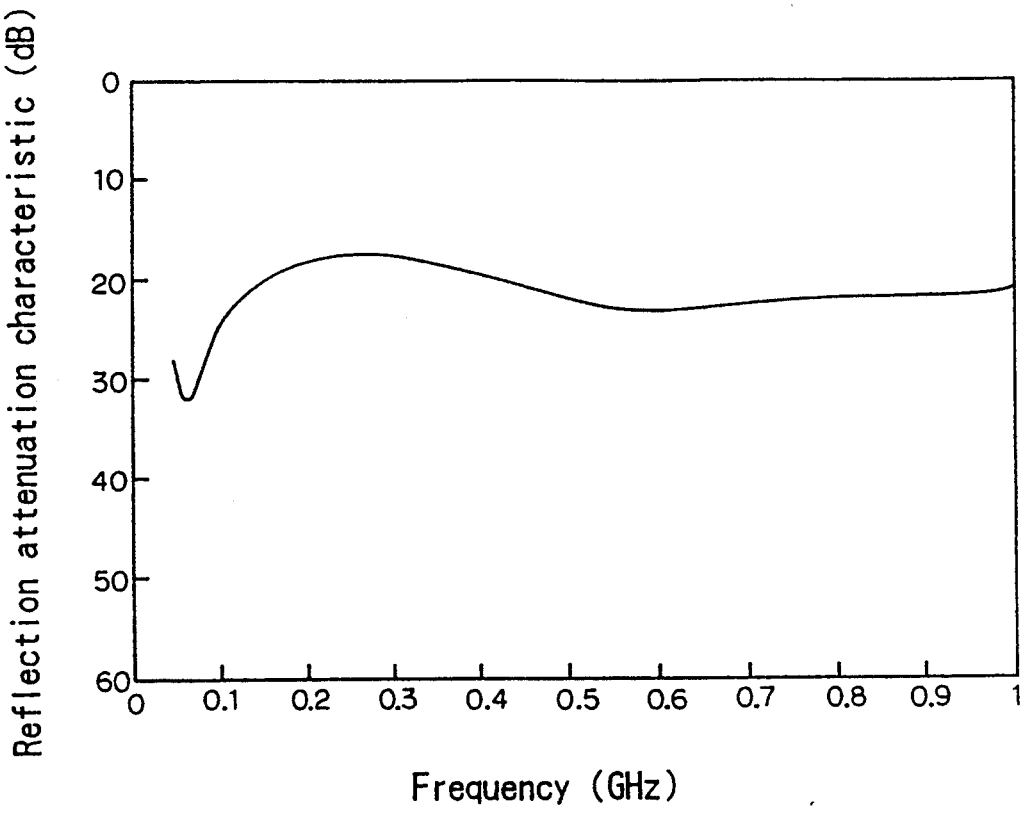
FIG. 7 is a graph showing a microwave absorption characteristic of a microwave absorber obtained in Example 6 (height: 300 mm, setting of 5.5 mm thick ferrite tile, dielectric loss material content: 1.8 g/liter, molding density: 120 kg/m$^3$).
Figure 8:
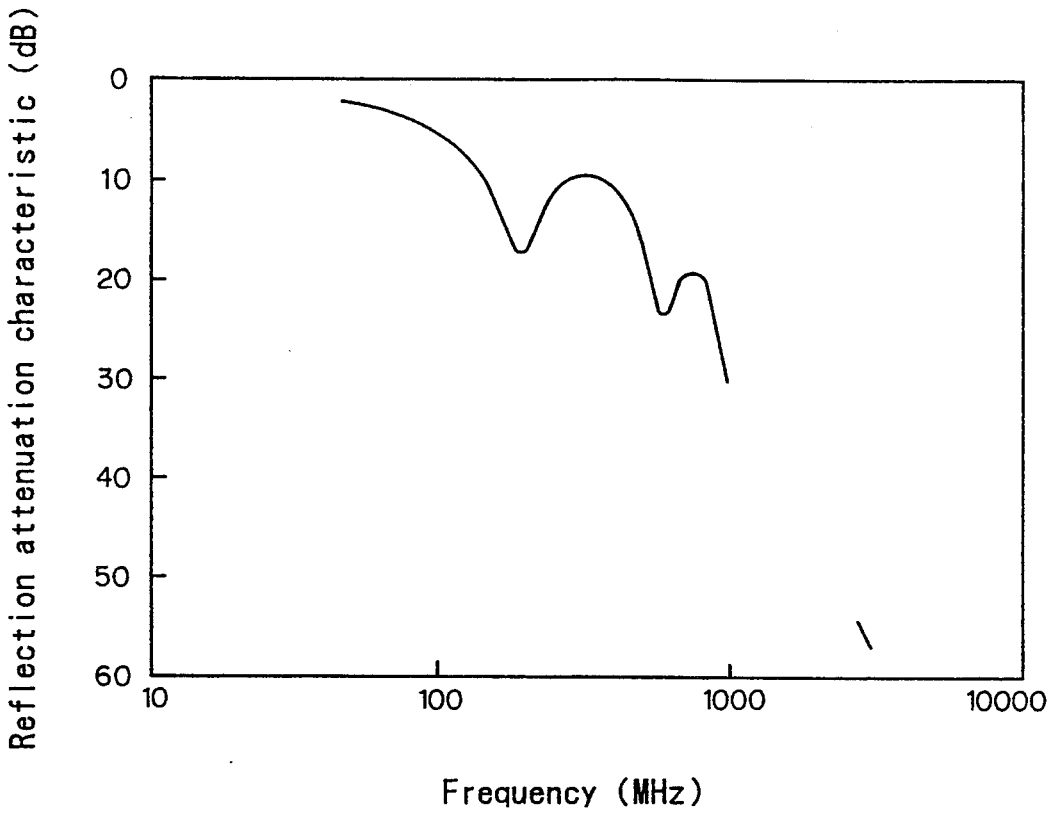
FIG. 8 is a graph showing a microwave absorption characteristic of a microwave absorber obtained in Example 7 (height: 300 mm, without ferrite tile, dielectric loss material content: 10 g/liter, molding density: 200 kg/m$^3$).
Figure 9:
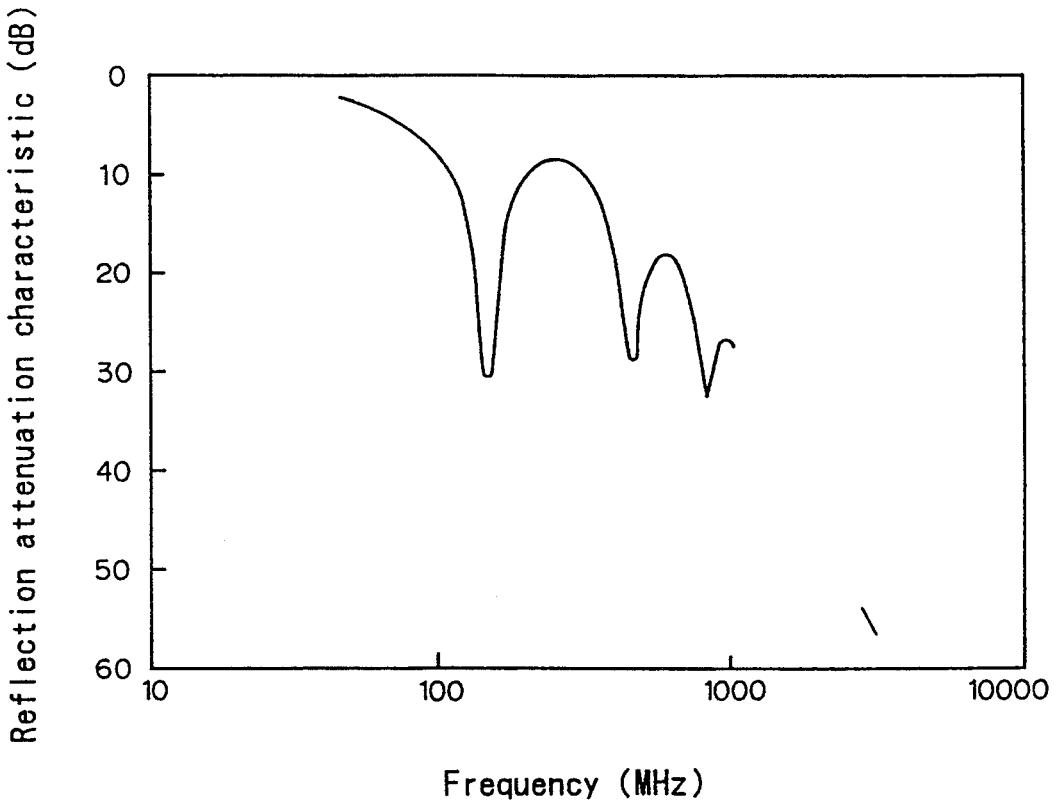
FIG. 9 is a graph showing a microwave absorption characteristic of a microwave absorber obtained in Example 8 (height: 300 mm, without ferrite tile, dielectric loss material content: 15 g/liter, molding density: 200 kg/m$^3$).
Figure 10:
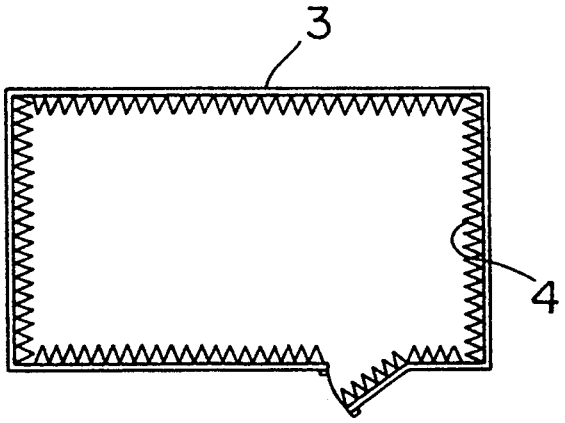
FIG. 10 PRIOR ART
FIG. 10 is a sectional view showing a conventional RF anechoic chamber.
Figure 11A:
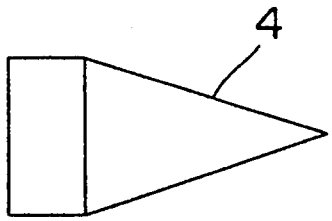
FIG. 11(a) PRIOR ART
FIGS. 11(*a*) and 11(*b*) are side view and plan view of a conventional pyramid shaped microwave absorber.
Figure 11B:
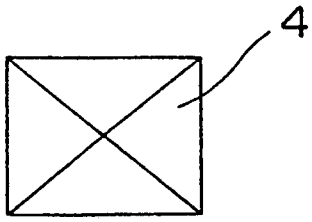
FIG. 11(b) PRIOR ART
Figure 12A:
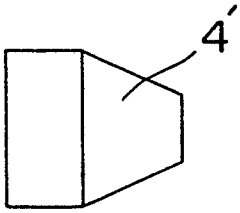
FIG. 12(a) PRIOR ART
FIGS. 12(*a*) and 12(*b*) are side view and plan view of a conventional wedge shaped microwave absorber.
Figure 12B:
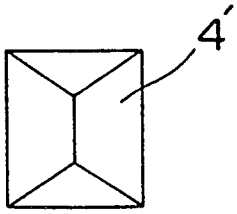
FIG. 12(b) PRIOR ART

The phenol resin foam of the invention can be manufactured by blending the phenol resin with a foaming agent, a curing agent, a dielectric loss material, and, as required, a foam shaping agent, a flame retardant agent, and others, injecting into a specified mold, heating, foaming, and curing.

Phenols to be used for the phenol resin include, for example, monovalent phenols such as phenol, cresol and xylenol, and bivalent phenols such as resorcinol and bisphenol, which may be used either alone or in mixture of two or more kinds. As aldehydes to be used in reaction with phenols, formaldehyde, acetaldehyde, paraformaldehyde, dioxane, trioxane, and other acetals may be preferably used.

The phenol resin used in the invention may be any one of resol type phenol resin, novolak type phenol resin, and modified phenol resin, and is not particularly limited.

In the resol type phenol resin, the viscosity at 25° C. is desired to be 500 to 50000 cps, preferably 1000 to 20000 cps, and the solid content (nonvolatile content) is desired to be 50 to 95%, preferably 70 to 90%. If the viscosity and solid content are lower than the specified ranges, the manufactured foam becomes fragile due to moisture, and it is hard to depart from the mold. If the viscosity and solid content exceed the specified ranges, it is extremely difficult to mix in dielectric loss material and others owing to excessive viscosity. The free formaldehyde component is preferred to be 5% or less of the phenol resin, and the smaller the formaldehyde content, the less is releases the formaldehyde smell when manufacturing.

As the novolak type phenol resin, any material for foaming manufactured in the known method can be used, and it is not particularly limited.

Examples of modified phenol resin include reaction products between phenol resin and drying oil such as tung oil and linseed oil; compounds wherein the hydroxy groups of phenols are etherified by an alkyl halide such as methyl chloride and epichlorohydrin, or are esterified by an alkylene carbonate such as ethylene carbonate; and compounds wherein the methylol groups are etherified by alkylene glycol such as ethylene glycol.

When the modified phenol resin is liquid, any material having the same viscosity and solid content as the resol type phenol resin may be used, and if solid, the material for foaming manufactured in the known method same as the novolak type phenol resin may be used, and it is not particularly limited.

The foaming agent to be blended in the phenol resin includes, for example, low boiling aliphatic hydrocarbons such as n-hexane, methylene chloride and trichlorofluoromethane, or their halides, and heat decomposable types such as dinitropentamethylene tetramine and benzene sulfonyl hydrazide. It is preferred to use the foaming agent within a range of 2 to 30 parts by weight to 100 parts by weight of the phenol resin.

The curing agent includes, for example, inorganic acids such as sulfuric acid and hydrochloric acid, aromatic sulfonic acids such as phenol sulfonic acid and toluene sulfonic acid, isocyanates such as diphenyl methane diisocyanate (MDI), and heat decomposable types such as hexamethylene tetramine. The curing agent may be preferably used in a range of 5 to 30 parts by weight to 100 parts by weight of phenol resin.

As the dielectric loss material, a conductive material showing a dielectric loss to incident electromagnetic waves of high frequency is preferably used. Practical examples include carbon black powder such as "KETJENBLACK" available from AKZO Corporation, and acetylene black, and conductive powder and whisker fibers such as "DENTALL" available from Otsuka Chemical Co., Ltd. (conductive potassium titanate whisker), and various carbon fiber and short fibers.

The dielectric loss material should be preferably used in a range of 0.4 to 10 parts by weight to 100 parts by weight of phenol resin. When the content of the dielectric loss material is lower than this range, the microwave absorption capacity is not sufficient. If exceeding the range, the viscosity of the resin liquid is too high when mixing, and hence manufacturing is difficult. However, even if the content is lower than the specified range, when much resin blend is injected into the mold in order to raise the density of the foam, a satisfactory microwave absorbing capacity may be obtained. More specifically, for example, if the carbon black is blended only 0.2 part by weight to 100 parts by weight of the phenol resin, by doubling the density of the foam, it is the same when 0.4 part by weight of carbon black is added. The same holds true when a smaller amount of resin blend is injected into the mold in order to obtain a foam of low density in case the content of the conductive material exceeds the specified range.

Examples of the foam shaping agent include nonionic surface active agents represented by ethylene oxide additives such as polyoxyethylene sorbitan fatty acid ester and polyoxyethylene alkyl phenol ether formaldehyde condensate, and silicone type nonionic surface active agents such as methyl polysiloxane polyalkylene oxide. The foam shaping agent may be used by 6 parts by weight or less to 100 parts by weight of phenol resin.

As the flame retardant agent, phosphor compounds such as ammonium polyphosphate, and halides such as tris($\beta$-chloroethyl)phosphate (TCEP) may be used. The flame retardant agent may be used by 30 parts by weight or less to 100 parts by weight of phenol resin.

Other fillers may include, for example, viscosity regulators such as cane sugar, reaction controller/diluent such as furfuryl alcohol and alkylene glycol, and reinforcing agents such as glass fiber, sepiolite as inorganic fibers. These fillers may be used by not more than 20 parts by weight to 100 parts by weight of phenol resin.

To obtain a microwave absorber in a pointed shape by mixing these materials, a sufficiently agitated and mixed blend is poured into a specified mold, and is heated, foamed and cured. The injection amount into the mold is determined so as to achieve the specified shape at a specified foaming factor, in consideration of the volume increment by foaming. Usually molding is performed in 1 to 10 minutes at 40° to 100° C.

The foaming factor is usually 3 to 40 times, and preferably 5 to 25 times. The density of the obtained foam should be about 30 to 300 kg/m$^3$, preferably in a range of 50 to 200 kg/m$^3$. If the density is lower than this range, the foam is fragile and brittle, and the pointed edge of the pyramid is easily broken. If the density exceeds the range, to the contrary, the foam is heavy and is hard to manufacture.

On the other hand, when the surface of the foam is covered with an incombustible sheet, the density of the foam may be less than the specified range, since the foam is protected with the incombustible sheet, and the defects of fragile and brittle properties may be substantially reduced. For example, when covered with an incombustible sheet, the density of the foam may be 10 kg/m$^3$ at the minimum.

To cover the foam surface with a incombustible sheet, it may be adhered to the surface of the foam after molding, but preferably, as shown in FIG. 1, a container 2 of an incombustible sheet in the same shape as a mold 1 is inserted in the mold 1 to fit to the inner wall of the mold 1, and a specified amount of the resin blend is injected, foamed and cured. Hence, the productivity is enhanced, and the foam can be parted easily from the mold 1. Incidentally, the mold 1 shown in FIG. 1 is for one pyramid, but coupling two or more molds, multiple foams with pointed shape such as pyramids may be obtained by one molding process.

The incombustible sheet is, incidentally, effective not only for protecting the foam, facilitating parting, and enhancing the productivity as mentioned above, but also for decorating the surface of the microwave absorber. That is, when the incombustible sheet is preliminarily colored in blue or other color, it is effective to prevent darkening or blackening of the microwave absorber due to carbon black or the like contained in the foam, so that a bright RF anechoic chamber without threatening sense can be built at low cost.

Such an incombustible sheet may be, for example, incombustible paper formed in sheet by using inorganic fibers such as glass fiber, potassium titanate fiber, sepiolite, and calcium silicate fiber, combined with, as required, a small amount of organic fibers such as pulp, rayon, and aramide fiber, flame retardant agent or incombustible agent such as aluminum hydroxide, calcium carbonate, antimony trioxide, clay, and mica, pigment, binder (e.g. colloidal silica, acrylic emulsion), and others. Instead of incombustible paper, woven or nonwoven cloth mainly composed of the above inorganic fibers may be also used. These incombustible sheets are required to be microwave permeable.

The thickness of the incombustible sheet is about 0.05 to 3 mm, preferably about 0.1 to 2 mm.

The incombustible sheet is obtained by preparing the material in a slurry form, filtering the slurry by cylinder mould or Fourdrinier, and drying. The container of the incombustible sheet is manufactured by folding the incombustible sheet in a desired shape by an automatic paper folding machine, and closing in a bag form with an adhesive. From the viewpoint of shape retaining property of the container, the basic weight of the incombustible sheet is desired to be 30 to 800 g/m$^2$.

As mentioned above, according to the invention, since thermosetting phenol resin foam is used, semi-incombustible or incombustible microwave absorber of high strength is presented. The phenol resin foam provides a uniform and high microwave absorbing capacity when adding a relatively small amount of dielectric loss material.

In particular, when the microwave absorber of the invention is formed in a pyramid-shape, the microwave absorption characteristic at high frequency is excellent.

Besides, when the surface of the phenol resin foam is coated with a colored incombustible sheet, a colored microwave absorber may be easily obtained.

Moreover, when the container of incombustible sheet in the same shape as the mold is placed inside the mold of pointed shape, the molded foam is parted easily, and the productivity is enhanced. Since the container retains its shape, the strength of the obtained microwave absorber is increased, and it is usable even if the density of the foam is low, and hence it is possible to obtain a microwave absorber of light weight and low cost. By reducing the weight of the foam, the working efficiency is enhanced.

EXAMPLES

The invention is described in further detail below by referring to reference examples and examples.

Reference Example 1 (preparation of a resol type phenol resin)

In a four-stoppered flask, 2.0 kg of phenol, 2.93 kg of 37% formaldehyde (molar ratio 1.7 mol), and 60 g of 20% potassium hydroxide aqueous solution as catalyst were charged, and allowed to react for 3 hours at 85°, the pH was neutralized to 6.0 by using phenol sulfonic acid, and the moisture in the resin was reduced to 6% by dehydration in vacuo. The obtained resol type phenol contained the nonvolatile content by 80%, the viscosity was 3000 cP/25° C., and the weight-average molecular weight was 460.

Reference Example 2 (preparation of a novolak type phenol resin)

In a four-stoppered flask, 2.0 kg of phenol, 1.03 kg of 37% formaldehyde (molar ratio 0.6 mol),and 3.9 g of oxalic acid as catalyst were charged, allowed to react for 2 hours at 95° C., the pH was neutralized to 6.0 by using potassium hydroxide, and the temperature was raised to 150° C. in 2 hours to dehydrate. After dehydration, by cooling, grinding by roll mill, and passing through 200 mesh sieve, novolak type phenol resin in powder form was obtained. The melting point of this oligomer was 102° C.

Reference Example 3 (preparation of a modified phenol resin)

Charging 500 g of novolak type phenol resin obtained in Reference Example 2 in an autoclave and heating to 130° C., 3 g of sodium hydroxide was added and mixed. Successively, 680 g of propylene oxide was gradually added, and was allowed to react for 2 hours. The reaction product was neutralized by acetic acid, filtered in vacuo, and an oxyalkyl product with hydroxyl value of 280 mg KOH/g was obtained.

Example 1

To 100 parts by weight of the resol type phenol resin obtained in Reference Example 1, 2 parts by weight of polyether siloxane copolymer ("L-5420" available from Nihon Unika Co., Ltd.) as foam shaping agent, 10 parts by weight of methylene chloride as foaming agent, and 3.85 parts by weight of "KETJENBLACK ECP-600JD" available from AKZO Corporation as dielectric loss material were added and mixed, and 17 parts by weight of 70% aqueous solution obtained by mixing naphthalene sulfonic acid and phenolsulfonic acid at 1:1 (ratio by weight), as hardening agent, was added, and the mixture was stirred for 20 seconds. The obtained mixture was poured in a mold (a pyramid form shown in FIG. 1, measuring 300 mm in length, 300 mm in width, 600 mm in height) setting a colored incombustible paper container inside and was foamed and cured in a drying machine at 70° C., and a microwave absorber composed of phenol resin foam was obtained.

Example 2

To 100 parts by weight of the resol type phenol resin obtained in Reference Example 1, 2 parts by weight of polyether siloxane copolymer ("SH-193" of Toray Industries, Inc.) as foam shaping agent, 8 parts by weight of methylene chloride as foaming agent, and 4.77 parts by weight of "KETJENBLACK ECP600JD" as dielectric loss material were added and mixed, and further 16 parts by weight of 67% aqueous solution of phenolsulfonic acid was added as hardening agent, and the mixture was stirred for 20 seconds. The obtained mixture was poured into the same mold as in Example 1 setting a colored incombustible paper container inside, and was foamed and cured in a drying machine at 70° C., and a microwave absorber composed of phenol resin foam was obtained.

Example 3

To 100 parts by weight of novolak type phenol resin obtained in Reference Example 2, 7 parts by weight of dinitroso pentamethylene tetramine as foaming agent and 0.66 part by weight of "KETJENBLACK ECP-600JD" as dielectric loss material were added and mixed, and further 10 parts by weight of hexamethylene tetramine was added as hardening agent, and dispersed and mixed well. The obtained mixture was poured into the same mold as in Example 1 setting a colored incombustible paper container inside, and foamed and cured in a drying machine at 130° C., and a microwave absorber composed of phenol resin foam was obtained.

Example 4

To 100 parts by weight of modified phenol resin obtained in Reference Example 3, 4 parts by weight of polyether siloxane copolymer ("SH-193" available from Toray Industries, Inc.) as foam shaping agent, 6 parts by weight of potassium octylate as reaction promoter, 10 parts by weight of "Flon 141b" available from Daikin Industries, Ltd. as foaming agent, and 3.85 parts by weight of "KETJENBLACK ECP-600JD" as dielectric loss material were added and mixed, and further 10 parts by weight of TCEP as flame retardant was added, and then 100 parts by weight of crude diphenyl methane diisocyanate as hardening agent was added, and stirred and mixed for 10 seconds. The obtained mixture was poured into the same mold as in Example 1 setting a colored incombustible paper container inside, and foamed and cured in a drying machine at 70° C., and a microwave absorber composed of phenol resin foam was obtained.

Example 5

To 100 parts by weight of resol type phenol resin obtained in Reference Example 1, 3 parts by weight of polyether siloxane copolymer ("L-5420" of Nihon Unika Co., Ltd.) as foam shaping agent, 7 parts by weight of "Flon 141b" available from Daikin Industries, Ltd. as foaming agent, and 1.92 parts by weight of conductive potassium titanate whisker ("DENTALL" available from Otsuka Chemical, Co., Ltd.) as dielectric loss material were added and mixed, and further 17 parts by weight of 68% aqueous solution mixing phenol sulfonic acid and p-toluene sulfonic acid at 1:1 (ratio by weight), as hardening agent, was added, and stirred and mixed for 20 seconds. The obtained mixture was poured into the same mold as in Example 1 setting a colored incombustible paper container inside, and foamed and cured in a drying machine at 70° C., and a microwave absorber composed of phenol resin foam was obtained.

Example 6

To 100 parts by weight of resol type phenol resin obtained in Reference Example 1, 2 parts by weight of polyether siloxane copolymer ("L-5420" available from Nihon Unika Co., Ltd.) as foam shaping agent, 8 parts by weight of methylene chloride as foaming agent, and 1.58 parts by weight of KETJENBLACK ECP-60JD as dielectric loss material were added and mixed, and further 14 parts by weight of 67% aqueous solution of phenol sulfonic acid was added as hardening agent, and stirred and mixed for 30 seconds. The obtained mixture was poured into a mold (having a pyramid form shown in FIG. 1, measuring 100 mm in length, 100 mm in width, 300 mm in height) setting a colored incombustible paper container inside, and foamed and cured in a drying machine at 60° C., and a microwave absorber composed of phenol resin foam was obtained.

Example 7

To 100 parts by weight of the resol type phenol resin obtained in Reference Example 1, 2 parts by weight of polyether siloxane copolymer ("L-5420" available from Nihon Unika Co., Ltd.) as foam shaping agent, 4 parts by weight of methylene chloride as foaming agent, 3 parts by weight of water and 5 parts by weight of ethylene glycol as viscosity regulator, and 5.20 parts by weight of "KETJENBLACK ECP-600JD" as dielectric loss material were added and mixed, and further 13 parts by weight of 67% aqueous solution of phenol sulfonic acid was added as hardening agent, and the mixture was stirred for 20 seconds. The obtained mixture was poured into the same mold as in Example 6 setting a colored incombustible paper container inside, and was foamed and cured in a drying machine at 60° C., and a microwave absorber composed of phenol resin foam was obtained.

Example 8

To 100 parts by weight of the resol type phenol resin obtained in Reference Example 1, 3 parts by weight of polyether siloxane copolymer ("SH-193" available from Toray Industries, Inc.) as foam shaping agent, 5 parts by weight of methylene chloride as foaming agent, 4 parts by weight of water, 6 parts by weight of propylene glycol, and 4 parts by weight of furfuryl alcohol as viscosity regulator, and 8.30 parts by weight of "KETJENBLACK ECP-600JD" as dielectric loss material were added and mixed, and further 13 parts by weight of 67% aqueous solution of phenol sulfonic acid was added as hardening agent, and the mixture was stirred for 20 seconds. The obtained mixture was poured into the same mold as in Example 6 setting a colored incombustible paper container inside, and was foamed and cured in a drying machine at 60° C., and a microwave absorber composed of phenol resin foam was obtained.

In the microwave absorbers obtained in the Examples, the compression strength and combustibility were measured. The results are shown in Table 1. Table 1also shows the height of the absorber, presence or absence of a ferrite tile, content of dielectric loss material (in the unit of grams of dielectric loss material in one liter of absorber), and the density of the absorber. The ferrite tile is for absorption of microwave used in combination with the microwave absorber composed of the foam, and the foam is mounted on the ferrite tile. The ferrite tile used in Examples is a Ni-Zn material in a thickness of 3.5 to 5.5 mm, and as the permeability characteristics, of the complex permeability at 100 MHz, the real number part $\mu'$ is about 10, and the imaginary number part $\mu''$ is about 80.

The compression strength was measured according to JIS K 7220 (Testing Method for Compressive Properties of Rigid Cellular Plastics). As the combustibility, the oxygen index was evaluated in conformity with JIS K 7201 (Testing Method for Flammability of Polymeric Materials Using the Oxygen Index Method). Herein, the oxygen index refers to the numerical value of the minimum oxygen concentration expressed in vol. % in the oxygen necessary for the material to continue combustion in the specified test condition.

TABLE 1

| | Example Number | | | | | | | |
|---|---|---|---|---|---|---|---|---|
| | 1 | 2 | 3 | 4 | 5 | 6 | 7 | 8 |
| Content of dielectric loss material (g/l) | 3.5 | 6.5 | 0.3 | 3.5 | 1.8 | 1.8 | 10 | 15 |
| Density of absorber (kg/m$^3$) | 102 | 147 | 53 | 90 | 98 | 120 | 200 | 200 |
| Height of absorber (mm) | 600 | 600 | 600 | 600 | 600 | 300 | 300 | 300 |
| Thickness of ferrite tile (mm) | 3.5 | 3.5 | 4.5 | 3.5 | 3.5 | 5.5 | — | — |
| Compressive strength (kg/cm$^2$) | 8 | 9 | 2 | 8 | 9 | 8 | 12 | 13 |
| Combustibility (oxygen index) | 40 | 42 | 42 | 32 | 41 | 40 | 40 | 38 |

It is known from Table 1 that the microwave absorbers obtained in the Examples possess high strength and incombustibility.

Furthermore, the microwave absorption characteristics of the microwave absorbers obtained in the Examples were evaluated. That is, in the vertical strip line type waveguide, the pyramid-shape microwave absorber obtained in each Example was installed, and the reflection attenuation factor of the microwave entering through the line by the absorber was measured by a network analyzer in a band from tens to hundreds of MHz. In the GHz band, by the arch test instead of the waveguide, the reflection attenuation factor was measured in the plane waves propagating in the free space, and the both results were fed into the computer, and produced as frequency characteristic graph. Incidentally, due to the nature of the arch test, continuous frequency characteristic was not obtained in the GHz band. Same as above, ferrite tiles were used in Examples 1 to 6.

Thus obtained frequency characteristic graphs of the microwave absorbers of Examples 1 to 8 are shown in FIGS. 2 to 9.

It is known from these diagrams that the microwave absorber of the invention possesses a high microwave absorption characteristic.

The disclosure of Japanese Patent Application No. 103158/1993 is incorporated herein by reference.

What is claimed is:

1. A microwave absorber comprising a phenol resin foam into which a dielectric loss material has been blended prior to foaming, a density of the phenol resin foam being in a range from 30 kg/m$^3$ to 300 kg/m$^3$.

2. The microwave absorber of claim 1, wherein a shape of the microwave absorber is pyramidal.

3. The microwave absorber of claim 1, wherein a surface of the phenol resin foam is covered with an incombustible sheet, the incombustible sheet including inorganic fiber.

4. The microwave absorber of claim 1, wherein the dielectric loss material is contained at a rate of 0.4 to 10 parts by weight to 100 parts by weight of the phenol resin.

5. A process for manufacturing a microwave absorber having a pointed shape, said process comprising:

setting, in a mold having a pointed shape, a container which has a shape that is the same as the shape of the mold and which is formed of an incombustible sheet, the incombustible sheet including an inorganic fiber;

pouring into the mold phenol resin into which a dielectric loss material is blended;

foaming the phenol resin; and curing the phenol resin.

6. The process for manufacturing a microwave absorber of claim 5, wherein a foaming agent is blended into the phenol resin.

7. The process for manufacturing a microwave absorber of claim 5, wherein a hardening agent is blended into the phenol resin.

8. The process for manufacturing a microwave absorber of claim 5, wherein a foam shaping agent is blended into the phenol resin.

9. The process for manufacturing a microwave absorber of claim 5, wherein a flame retardant is blended into the phenol resin.

10. A microwave absorber comprising a phenol resin foam into which a dielectric loss material has been blended prior to foaming.

11. The microwave absorber of claim 10, wherein a shape of the microwave absorber is pyramidal.

12. The microwave absorber of claim 10, wherein a surface of the phenol resin foam is covered with an incombustible sheet, the incombustible sheet including inorganic fiber.

13. The microwave absorber of claim 10, wherein the dielectric loss material is contained at a rate of 0.4 to 10 parts by weight to 100 parts by weight of phenol resin.

* * * * *